US007690904B2

(12) United States Patent
Noelle

(10) Patent No.: US 7,690,904 B2
(45) Date of Patent: Apr. 6, 2010

(54) METHOD AND INSTALLATION FOR PRODUCING A NONWOVEN FABRIC EXHIBITING GOOD PROPERTIES OF TENSILE RESISTANCE

(75) Inventor: Frédéric Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 1340 days.

(21) Appl. No.: 10/529,842

(22) PCT Filed: Oct. 10, 2003

(86) PCT No.: PCT/FR03/02989

§ 371 (c)(1),
(2), (4) Date: Mar. 31, 2005

(87) PCT Pub. No.: WO2004/033782

PCT Pub. Date: Apr. 22, 2004

(65) Prior Publication Data

US 2006/0286887 A1 Dec. 21, 2006

(51) Int. Cl.
*B28B 5/00* (2006.01)

(52) U.S. Cl. ..... 425/83.1; 442/401; 442/408; 264/165

(58) Field of Classification Search ..... 425/500, 425/319, 340, 363, 83.1; 442/401, 408; 264/165
See application file for complete search history.

(56) References Cited

U.S. PATENT DOCUMENTS

| | | | | |
|---|---|---|---|---|
| 3,485,706 | A | 12/1969 | Evans | |
| 3,853,651 | A * | 12/1974 | Porte | 156/73.6 |
| 5,768,756 | A * | 6/1998 | Noelle | 28/104 |
| 6,050,469 | A * | 4/2000 | Brabant et al. | 226/183 |
| 6,663,373 | B2 * | 12/2003 | Yoshida | 425/72.2 |
| 2002/0168910 | A1 * | 11/2002 | Vuillaume et al. | 442/381 |

FOREIGN PATENT DOCUMENTS

WO WO 01/51693 A1 7/2001

* cited by examiner

*Primary Examiner*—Khanh Nguyen
*Assistant Examiner*—Saeed M Huda
(74) *Attorney, Agent, or Firm*—Pearne & Gordon LLP

(57) ABSTRACT

The invention concerns an installation for producing a non-woven fabric comprising a spun bond lathe depositing a web of filaments on a first conveyor, the mat being consolidated on a first mobile element by entangling means. The invention is characterized in that it comprises means for passing, without any change in ratio, the mat of filaments on a first mobile element whereon the mat is consolidated by hydro-entangling means.

10 Claims, 1 Drawing Sheet

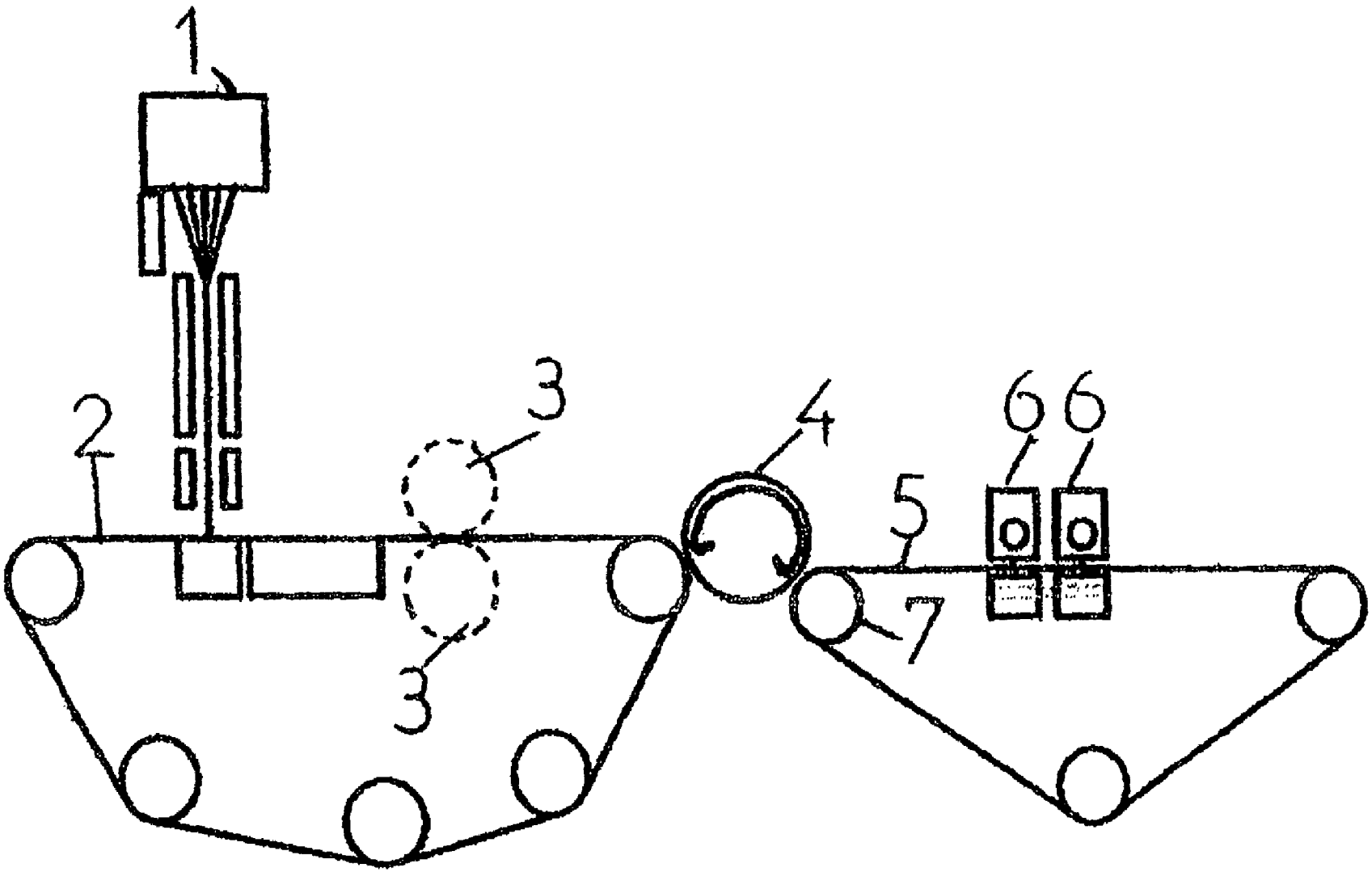
single figure

METHOD AND INSTALLATION FOR PRODUCING A NONWOVEN FABRIC EXHIBITING GOOD PROPERTIES OF TENSILE RESISTANCE

The present invention relates to methods and installations for the production of nonwoven fabrics. The invention relates more particularly to the production of nonwoven fabrics with the aid of a spun-bonding tower depositing a mat of filaments onto a first conveyor.

In the spun-bonding art, a very loose mat which is deposited onto a first conveyor is consolidated by compression and fusion in a calender. Fusion impairs the material so that the mat has less strength and a more plastic feel. Fusion densities the material and makes it rigid. Chemical binding involves the addition of costly chemical products which are not desirable for some applications.

The U.S. Pat. No. 3,485,706 has already described a method and an installation in which the mat of filaments which is deposited onto a first conveyor of a spun-bonding tower is consolidated by water-jet entanglement means.

The invention improves the method and installation described in U.S. Pat. No. 3,485,706 by making it possible to obtain an unwoven fabric having better properties.

The subject of the invention is, therefore, a method for preserving the ratio of the tensile strength in the length direction to the tensile strength in the breadth direction of a mat of filaments which is in displacement, characterized in that the mat is subjected to a vacuum, at the same time being applied to a support during the passage from a conveyor to a movable element.

The movable element may be a second conveyor or a cylinder or a hollow drum.

It has now been understood that it was not necessary to use the conveyor, onto which the mat of filaments which is in displacement is deposited from the spun-bonding tower, as a movable element on which the entanglement of the filaments by means of pressurized water jets takes place. The mat being consolidated, which is to be entangled by the entanglement means, catches in the meshes of the conveyor which are too large, so that the nonwoven fabric finally obtained has marks which make it unfit for sale. Entanglement is likewise of lower quality on account of this catching and because of the structure of the movable element. The idea therefore was to change conveyors, adopting a more air-permeable conveyor as the first conveyor and a less air-permeable conveyor or cylinder for carrying out consolidation by entanglement with the aid of water jets. However, it became clear that the passage from a conveyor to this movable element was detrimental to the properties of the nonwoven fabric and, in particular, caused the ratio of the tensile strength in the length direction to the tensile strength in the breadth direction of the nonwoven fabric to be poorer than that of the mat of filaments which came from the spun-bonding tower. Consequently, now, according to the invention, the mat is passed from the first conveyor to the movable element, at the same time being subjected to a vacuum applying it to a support. By this means, the ratio of the tensile strength in the length direction to the tensile strength in the breadth direction of the mat of filaments which is in displacement is preserved in the nonwoven fabric finally obtained after consolidation.

According to one embodiment, this ratio can even be improved by imparting to the support, which is in the form of a second movable element, a lower linear speed than that of the first conveyor.

The invention is also aimed at an installation for producing a nonwoven fabric, comprising a spun-bonding tower depositing a mat of filaments onto a first conveyor, the mat being delivered on a first movable element to means for consolidation by entanglement. According to the invention, means are provided which are intended for causing the mat of filaments to pass onto the first movable element, without modifying the ratio of the tensile strength in the length direction to the tensile strength in the breadth direction of said mat.

Said means may comprise, in particular, a second movable element having devices for the application of a vacuum which maintains the mat on the outer surface of the second movable element.

The second movable element may be a drum or a conveyor.

The first conveyor is more air-permeable than the first movable element. The first conveyor has, for example, an air permeability of 500 to 1100 CFM (cubic feet per minute) (14.1 $m^3$/min to 31 $m^3$/min), while the second movable element has an air permeability of 50 to 500 (1.41 $m^3$/min to 14.1 $m^3$/min).

The first conveyor (2) is generally a double or triple layer synthetic cloth with antistatic properties and high roughness. The second movable element (5) is a single layer synthetic or metallic cloth with linen, twill or satin reinforcement and with low roughness.

Preferably, the first conveyor has a greater roughness than the second movable element.

According to a particularly estimable embodiment, the first conveyor delivers the mat directly to the means intended for causing the mat of filaments to pass onto the first movable element. The term "directly" is understood, in particular, to mean that there is no interposition of a calender.

The invention is aimed, finally, at the use of a method or an installation according to the invention for preserving the ratio of the tensile strength in the length direction to the tensile strength in the breadth direction of a mat of filaments which is in displacement.

The air-permeability is measured as follows:

- the permeability measurement is carried out on a permeability meter PX 3300 sold by the company TEXTEST;
- the cloth sample is placed on the measuring head of the appliance;
- the air-permeability value is given directly by the appliance in CFM for a pressure differential of 100 pascal;
- the value retained is the average of 5 measurements.

The single FIGURE of the appended drawing illustrates the invention.

The single FIGURE is a diagrammatic view of an installation for producing a nonwoven fabric. It comprises a spun-bonding tower 1. A spun-bonding tower comprises a device for the extrusion of polymers, in particular a polypropylene or a polyester, which emerges in a spinneret providing filaments of polymers which are subsequently cooled in a cooling device, then, still in the downward direction, drawn in a drawing device and deposited in the form of a mat onto a first endless conveyor 2 having good air permeability and relatively high roughness, in such a way that the filaments are deposited onto its surface without slipping. The upper strand of the conveyor 2, onto which the mat of filaments is deposited, passes into the nip between two presser rollers 3 forming a compacting device. These presser rollers have been illustrated by dashes in this FIGURE since they are optional. At the exit of the first conveyor 2, the mat passes onto a hollow drum 4 (second movable element), within which a vacuum prevails, so that the mat is applied to the lower part of the drum 4 and so that the properties of the mat are not modified, as would be the case if it passed directly from one conveyor to another, with the resulting tensile phenomena. At the exit of the drum 4, the mat is taken up again by a conveyor 5 (first movable element) and passes under devices 6 for consolidation by the projection of water jets with a diameter of between 50 and 250 microns and under a pressure of between 20 and 1000 bar, and water is projected onto the mat by these devices 6, thereby entangling the fibers. The conveyor 5 is less air-permeable than the conveyor 2.

That return roller 7 of the conveyor 5 which is nearest to the suction cylinder 4 may itself be equipped with suction to facilitate the passage of the mat from the drum 4 to the conveyor 5.

In one embodiment, the drum 4 rotates counterclockwise at a lower linear speed than the displacement speed of the conveyor 2 from left to right in the FIGURE.

The invention claimed is:

1. An installation for producing a nonwoven fabric, comprising a spun-bonding tower depositing a mat of filaments onto a first conveyor, the first conveyor being arranged to deliver the mat to transfer means for causing the mat of filaments to pass onto a first movable conveying element for supporting the mat during consolidation, the mat being free of prior consolidation, and consolidation means for consolidating the mat supported on the first movable conveying element by entanglement, characterized in that the transfer means for causing the mat of filaments to pass onto the first movable conveying element comprise a second movable conveying element having a device for the application of a vacuum which maintains the mat on an outer surface of the second movable conveying element, the first conveyor and the first movable conveying element each include an elongate generally flat run along which the mat is conveyed and supported, the first conveyor is more air-permeable than the first movable conveying element, and the consolidation means include fluid impingement of the mat with the lesser air-permeability of the first movable conveying element more fully supporting the mat as compared with the first conveyor to improve the filament entanglement by the fluid impingement and to thereby enhance consolidation and preservation of the ratio of the tensile strength in the length direction to the tensile strength in the breadth direction.

2. The installation as claimed in claim 1, characterized in that the second movable element is a drum or a conveyor.

3. The installation as claimed in claim 1, characterized in that the first conveyor has an air permeability of between 500 and 1100 CFM (14.1 and 31 m3/min).

4. The installation as claimed in claim 3, characterized in that the first movable conveying element has an air permeability of between 50 and 500 CFM (1.41 and 14.1 m3/min).

5. The installation as claimed in claim 1, characterized in that the first conveyor is a multilayer cloth, while the first movable conveying element is a single layer cloth.

6. The installation as claimed in claim 1, characterized in that the first conveyor delivers the mat directly to the transfer means.

7. The installation as claimed in claim 1, characterized in that the first movable conveying element has a suction device which cooperates with the transfer means, in order to facilitate the passage of the mat from the means to the first movable conveying element.

8. The installation as claimed in claim 1, characterized in that said installation is constructed and arranged to preserve the ratio of the tensile strength in the length direction to the tensile strength in the breadth direction of said mat of filaments which is in displacement, coming from said spun-bonding tower and going to said means for consolidation by entanglement.

9. The installation as claimed in claim 1, characterized in that said conveyor operates at a conveyor linear speed to convey said mat of filaments and said second movable conveying element operates at a conveying element linear speed to cause said mat of filaments to pass onto said first movable conveying element, and said second conveying element linear speed is less than said conveyor linear speed.

10. An installation for producing a nonwoven fabric comprising a spun-bonding tower depositing a mat of filaments onto a first conveyor, transfer means for causing the mat of filaments to pass from the first conveyor onto a first movable conveying element for supporting the mat during consolidation, the mat being free of prior consolidation, and consolidation means for impinging fluid on the mat and consolidating the mat as it is supported on the first movable conveying element, characterized in that the transfer means for causing the mat of filaments to pass onto the first movable conveying element comprise a second movable conveying element having a device for the application of a vacuum which maintains the mat on an outer surface of the second movable conveying element, the first conveyor and the first movable conveying element each having an elongate generally flat run along which the mat is conveyed and supported, and the first conveyor is more air-permeable than the first movable conveying element to more fully support the mat during consolidation to improve the filament entanglement by the impinging fluid, and to thereby enhance consolidation and preservation of the ratio of the tensile strength in the length direction to the tensile strength in the breadth direction.

* * * * *